US008851704B2

(12) United States Patent
Peng et al.

(10) Patent No.: US 8,851,704 B2
(45) Date of Patent: Oct. 7, 2014

(54) SEAMLESS CONNECTING SHELL AND LIGHTING DEVICE USING THE SAME

(75) Inventors: Li-Chung Peng, Hsinchu (TW); Yarn-Chen Chen, Hsinchu (TW)

(73) Assignee: GEEE Creations, Inc., Zhubei, Hsinchu County (TW)

( * ) Notice: Subject to any disclaimer, the term of this patent is extended or adjusted under 35 U.S.C. 154(b) by 351 days.

(21) Appl. No.: 13/453,900

(22) Filed: Apr. 23, 2012

(65) Prior Publication Data

US 2013/0176720 A1 Jul. 11, 2013

(30) Foreign Application Priority Data

Jan. 6, 2012 (TW) ..... 101100580

(51) Int. Cl.
*F21V 21/005* (2006.01)

(52) U.S. Cl.
USPC . 362/223; 362/224; 362/217.16; 362/217.17; 362/249.01; 362/249.02; 362/249.03

(58) Field of Classification Search
USPC ..... 362/217.02, 217.08, 217.1, 362/217.11–217.17, 219–224, 362/249.01–249.19, 332
See application file for complete search history.

(56) References Cited

U.S. PATENT DOCUMENTS

| | | | | |
|---|---|---|---|---|
| 6,435,697 | B1 * | 8/2002 | Simmons et al. | 362/219 |
| 6,882,111 | B2 * | 4/2005 | Kan et al. | 315/122 |
| 7,961,113 | B2 | 6/2011 | Rabiner et al. | |
| 2011/0310604 | A1 * | 12/2011 | Shimizu et al. | 362/235 |
| 2013/0279160 | A1 * | 10/2013 | Myers et al. | 362/224 |

FOREIGN PATENT DOCUMENTS

| | | | |
|---|---|---|---|
| JP | 2009-123527 | A | 6/2009 |
| WO | WO-2010/084726 | A1 | 7/2010 |

OTHER PUBLICATIONS

Zumtobel-Linaria, Zumtobel Lighting GmbH, Article No. 04 900 303-UK, May 2009, pp. 1-32.
New A.A.G. Stucchi Lampholder Art. 1282-SLS/FAU for Osram "Lumilux T5 Ho Seamless' Lamps With G5 Caps," A.A.G. Stucchi, Feb. 2010, pp. 1-2.
"Lighting systems," Nippo Electric Co., Ltd., Tokyo, Japan, Apr. 2008, pp. 1-20.
"Inox Seamless Lighting Guide" Inox, United Kingdom, 2010, pp. 1-20.
SlimLite CS —"The intelligent solution for variable strip lighting," Hera GmbH & Co. KG, Enger, Germany, Sep. 2009, pp. 1-12.
"Neon LED Tube Series," Dec. 10, 2008, pp. 88-137.
Philips Indoor LED, Feb. 4, 2009, pp. 1-35.

* cited by examiner

*Primary Examiner* — Karabi Guharay
*Assistant Examiner* — Nathaniel Lee
(74) *Attorney, Agent, or Firm* — Muncy, Geissler, Olds & Lowe, P.C.

(57) ABSTRACT

The present invention provides a shell for a lighting device. The shell comprises a first lamp body, a second lamp body, a first connecting part, and a second connecting part. The ends of the second lamp body have a first end surface and a second end surface. The first connecting part lying along a first direction is set in the first end surface and threads through the first bottom surface. The second connecting part lying along a direction opposite to the first direction is set in the second end surface and threads through the second bottom surface. When the first lamp body is connected with the second lamp body, the two ends of the first lamp body are disposed extending over edges of the first end surface and the second end surface separately.

17 Claims, 10 Drawing Sheets

SEAMLESS CONNECTING SHELL AND LIGHTING DEVICE USING THE SAME

BACKGROUND OF THE INVENTION (a) Field of the Invention

The invention relates to a lighting device using a shell, particularly to a shell for a lighting device to make lighting devices connected in series appear to be a continuous light source.

(b) Description of the Related Art

A conventional light fixture is difficult in mounting and use due to structural limitation.

Furthermore, some of light fixtures may have a function of tandem connection but the design of their shell structures is very complicate and thus connection is difficult to perform. In addition, the connection portion between two light fixtures has a zone with no light source. In other words, light sources are discontinuous at the connection portion to result in imperfections in functionality and appearance.

BRIEF SUMMARY OF THE INVENTION

One object of the invention is to provide a lighting device, having a function of easy connection.

One object of the invention is to provide a lighting device, having a function of easy installation.

One object of the invention is to provide a lighting device, being mounted via rotating by a preset angle.

One object of the invention is to provide a lighting device, light sources at the connection portion of which is continuous.

One embodiment of the invention provides a shell for a lighting device. The shell comprises a first lamp body, a second lamp body, a first connecting part, and a second connecting part. The first lamp body has a first long line and a first short line where the first long line lies along a first direction. The second lamp body has a second long line. The second long line has a length not more than that of the first long line, the second long line lies along the first direction, and two ends of the second lamp body have a first end surface and a second end surface, separately. The first connecting part is set in the first end surface and extrudes (or threads) through the first end surface along the first direction. The second connecting part is set in the second end surface and extrudes (or threads) through the second end surface along a direction opposite to the first direction. The first lamp body and the second lamp body are assembled (connected) together and the two ends of the second lamp body are drawn back inside the first lamp body. The two ends of the first lamp body are disposed extending over edges of the first end surface and the second end surface separately. The sum of lengths of the first connecting part, the second connecting part and the second long line is not larger than that of the first long line. In this specification, the long line overlaps with the long axis of an object but has a definite length, that is, not unlimited line while the short line overlaps with the short axis of the object but has a definite length. The long axis and the short axis are two axes of symmetry of the object.

Furthermore, one embodiment of the invention provides a lighting device. The lighting device comprises a first lamp body, a light-emitting device, a second lamp body, a driver device, a first connecting part, a second connecting part, and two lamp socket bodies. The first lamp body has a first long line and a first short line where the first long line lies along a first direction. The light-emitting device is disposed inside the first lamp body to constitute a light source. The second lamp body has a second long line where the second long line has a length not more than that of the first long line, the second long line lies along the first direction, and two ends of the second lamp body have a first end surface and a second end surface, separately. The driver device is coupled to the light-emitting device and disposed inside the first lamp body. The first connecting part is set in the first end surface and extrudes through the first end surface along the first direction. The second connecting part is set in the second end surface and extrudes through the second end surface along a direction opposite to the first direction. The two lamp socket bodies each comprise a power conducting device inside and are coupled to the driver device and the light-emitting device where the lamp socket bodies each comprise a groove and a turning structure. The first lamp body and the second lamp body are assembled (or connected) together and the two ends of the first lamp body are disposed extending over edges of the first end surface and the second end surface separately. The total length of the first connecting part, the second connecting part and the second long line is not larger than that of the first long line and the distance between outer edges of the lamp socket bodies is not larger than the length of the first long line.

Therefore, the lighting device according to the invention shields the lamp socket bodies and thus the lamp socket bodies are hidden or shielded by the shell when the lighting device is connected to one other lighting device so that light sources at the connection portion between the lighting devices is not discontinuous and appearance is improved as well as usability.

Other objects and advantages of the invention can be better understood from the technical characteristics disclosed by the invention. In order to clarify the above mentioned and other objects and advantages of the invention, examples accompanying with figures are provided and described in details in the following.

DETAILED DESCRIPTION OF THE INVENTION

Figure 1A:
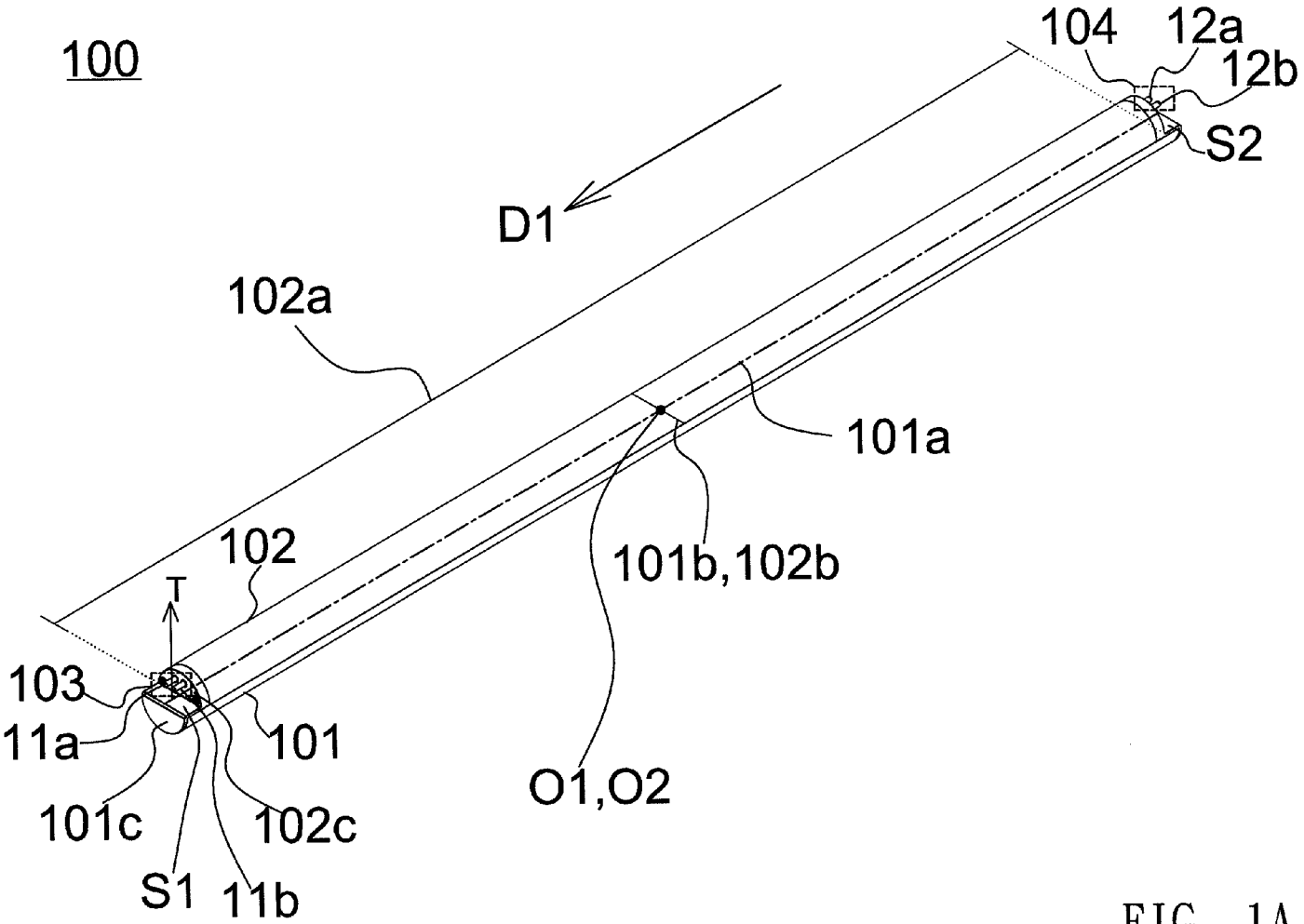
FIG. 1A shows a three-dimensional schematic diagram illustrating a shell according to one embodiment of the invention.
Figure 1B:
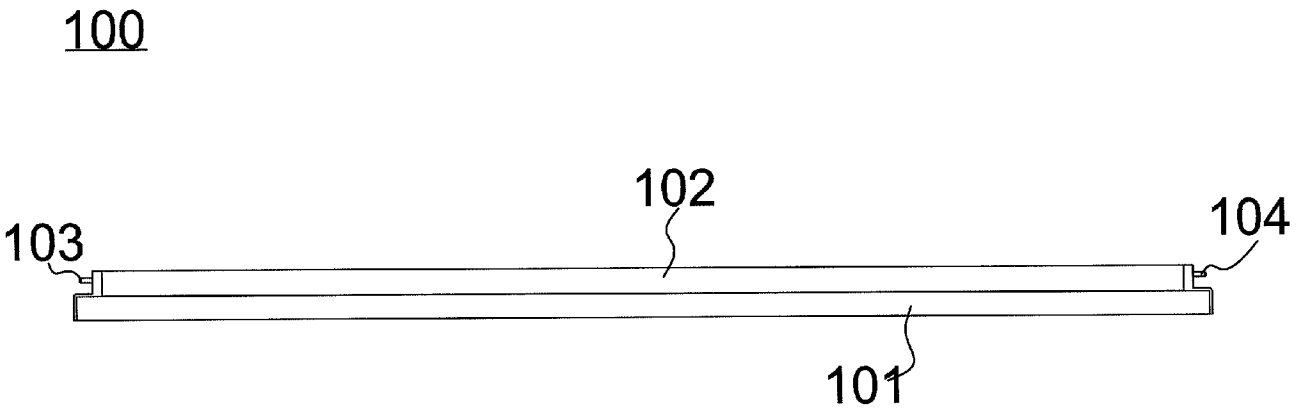
FIG. 1B shows a side-view schematic diagram illustrating a shell according to one embodiment of the invention.

Please simultaneously refer to FIGS. 1A and 1B. FIG. 1A shows a three-dimensional schematic diagram illustrating a shell according to one embodiment of the invention and FIG. 1B shows a side-view schematic diagram illustrating a shell according to one embodiment of the invention. The shell 100 is applicable to a linear lighting device for seamlessly connection. The shell 100 comprises lamp bodies 101, 102 and connecting parts 103, 104.

In this embodiment, the lamp body 101 has a long line 101*a* and a short line 101*b* and the lamp body 101 has a geometrical shaped hollow cylindrical structure. In addition, a light-emitting device (not shown) is disposed in an interior space of the lamp body 101 in order to protect the light-emitting device and the light-emitting device is used to constitute a light source.

In one embodiment, the light-emitting device can be implemented by a solid-state light-emitting device. In another one embodiment, the light-emitting device can be implemented by an array of light emitting diodes. However, the invention is not limited to the above examples and the light-emitting device can be implemented by any current or future light-emitting device.

The lamp body 101 has the long line 101*a* and the short line 101*b*. The long line 101*a* lies along a direction Dl. The lamp body 101 has end surfaces 101*c* and 101*d* (not shown) separately at two ends of the long line 101*a*. In other words, the third end surface and the fourth end surface are end surfaces 101*c* and 101*d*. The end surface 101*c* and the end surface 101*d* facing each other are disposed at the two sides of the lamp body 101. In one embodiment, the lamp body 101 has a geometrical shaped hollow cylindrical structure and thus the end surfaces 101*c* and 101*d* have its geometrical cross-sectional shape but the invention is not limited to this example. The lamp body 102 has a long line 102*a* and a short line 102*b*. The lamp body 102 has a geometrical shaped hollow cylindrical structure. In this embodiment, the length of the long line 102*a* is not larger than that of the long line 101*a*. In addition, a driver device (not shown) is disposed inside the lamp body 102 and coupled to the light-emitting device to drive the light-emitting device. Moreover, the lamp body 102 is used to protect the driver device and the length of the long line 102*a* is smaller than that of the long line 101*a*. The long line 102*a* lies along the direction D1 and is parallel to the long line 101*a*. The lamp body 102 has two end surfaces 102*c* and 102*d* (not shown) at its two ends. In other words, the first end surface and the second end surface of the lamp body 102 are the end surfaces 102*c* and 102*d*. The end surface 102*c* and the end surface 102*d* facing each other are disposed at two sides of the lamp body 102.

Since the two end surfaces 101*c* and 101*d* of the lamp body 101 are disposed at the two ends of the long line 101*a* and the two end surfaces 102*c* and 102*d* of the lamp body 102 are disposed at the two ends of the long line 102*a*, the locations of the two end surfaces 102*c* and 102*d* are drawn back inside the shell 100, compared to the two end surfaces 101*c* and 101*d*.

In addition, in another embodiment of the invention, the two ends of the lamp bodies 101 and 102 separately are provided with corresponding side caps to seal the lamp bodies 101 and 102 to protect circuits inside the lamp bodies 101 and 102. Thus, the end surfaces 101*c* and 101*d* are positioned on the side caps of the lamp body 101 and the end surfaces 102*c* and 102*d* are positioned on the side caps of the lamp body 102.

In one embodiment, the lamp body 102 has a semicircle and hollow cylindrical structure and the end surfaces 102*c* and 102*d* are semicircle-shaped. However, the invention is not limited to this example.

It should be noted that in this embodiment the shape and area of the end surfaces 101*c* and 101*d* are the same and correspondingly the shape and area of the end surfaces 102*c* and 102*d* are the same. However, the invention is not limited to this example. In the invention, there is a connecting surface (not shown) when the lamp body 101 and the lamp body are connected (or assembled together) and the intersection between the mid-points of the long line 101*a* and the short line 101*b* is a center point O1 and the intersection between the mid-points of the long line 102*a* and the short line 102*b* is a center point O2. When the lamp body 101 and the lamp body are connected or assembled, the center point O1 and the center point O2 overlap. In other words, when the lamp body 101 and the lamp body 102 are connected or assembled, the geometrical center of symmetry of the lamp body 101 overlaps with that of the lamp body 102.

Besides, since the length of the long line 101*a* of the lamp body 101 is larger than that of the long line 102*a* and the locations of the two end surfaces 102*c* and 102*d* are drawn back inside the shell 100, compared to the two end surfaces 101*c* and 101*d*, the lamp body 101 has two flat surfaces S1 and S2, when the lamp body 101 and the lamp body 102 are connected, are adjacent to the end surfaces 101*c* and 101*d*, respectively. The normal T of the flat surfaces Si and S2 is perpendicular to the long line 101*a* and the short line 101*b*.

It should be noted that the characteristic of lamp body 101 and the lamp body 102 connected is that the two ends of the lamp body 101 are set extending over the edges of the end surfaces 102*c* and 102*d* of the lamp body 102. In other words, the lamp body 102 is drawn back, compared to the lamp body 101.

The connecting part 103 is disposed in the end surface 102*c* and has two metal connecting terminals 11*a* and 11*b*. The metal connecting terminals 11*a* and 11*b* are coupled to a driver circuit and used to electrically connect to a lamp socket (not shown). The metal connecting terminals 11*a* and 11*b* extrude from the end surface 102*c* and extend along the direction D1.

The connecting part 104 is disposed in the end surface 102*dc* and has two metal connecting terminals 12*a* and 12*b*. The metal connecting terminals 12*a* and 12*b* are coupled to a driver circuit and used to electrically connect to a lamp socket (not shown). The metal connecting terminals 12*a* and 12*b* extrude from the end surface 102*d* and extend along a direction opposite to the direction D1.

It should be noted that in the invention the total length of the connecting parts 103, 104 and the long line 102*a* is not larger than that of the long line 101*a*. In other words, after the metal connecting terminals 11*a* and 11*b* are connected with the lamp body 102, the metal connecting terminals 11*a* and 11*b* are positioned above the flat surface S1 and are not over the territory of the flat surface S1. Correspondingly, after the metal connecting terminals 12*a* and 12*b* are connected with the lamp body 102, the metal connecting terminals 12*a* and 12*b* are positioned above the flat surface S2 and are not over the territory of the flat surface S2.

Figure 2A:
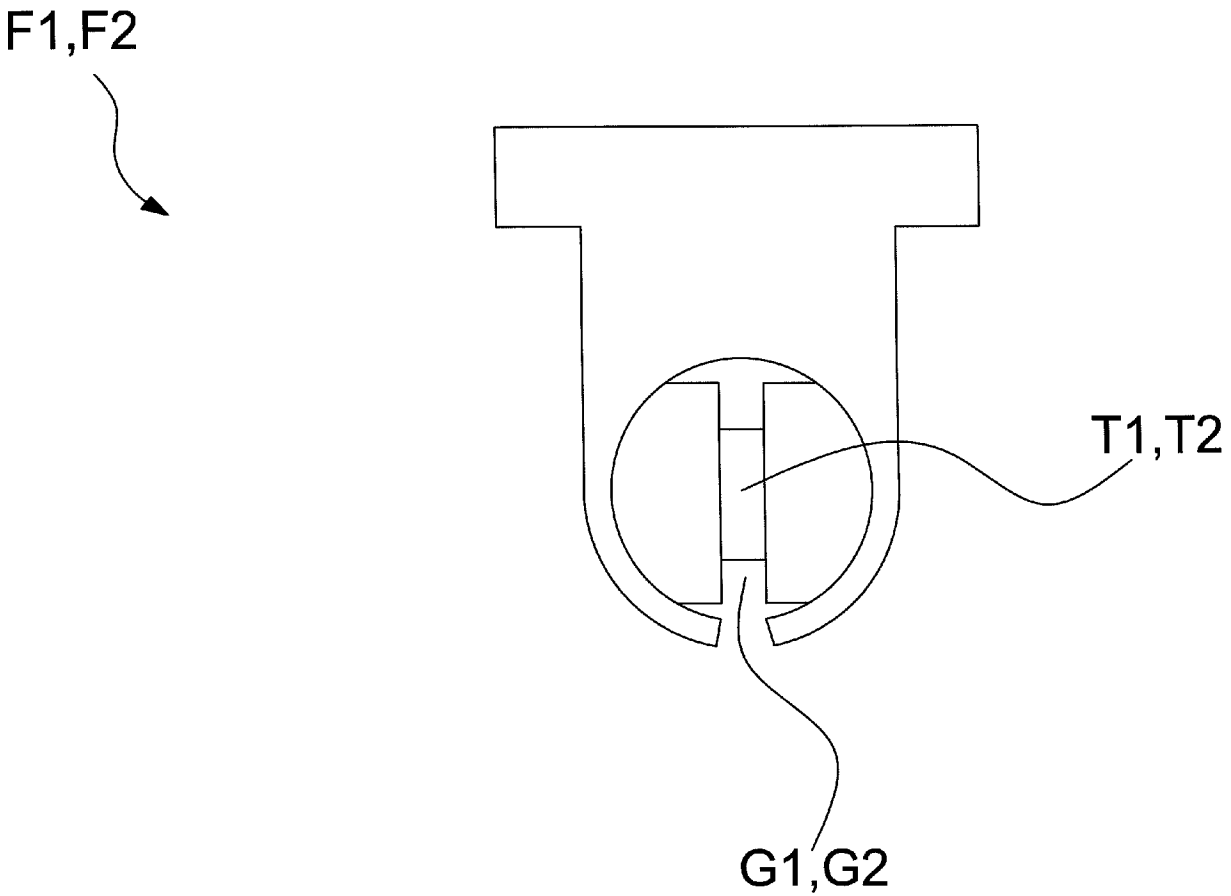
FIG. 2A shows a side-view schematic diagram illustrating a lamp socket body according to one embodiment of the invention.
Figure 2B:
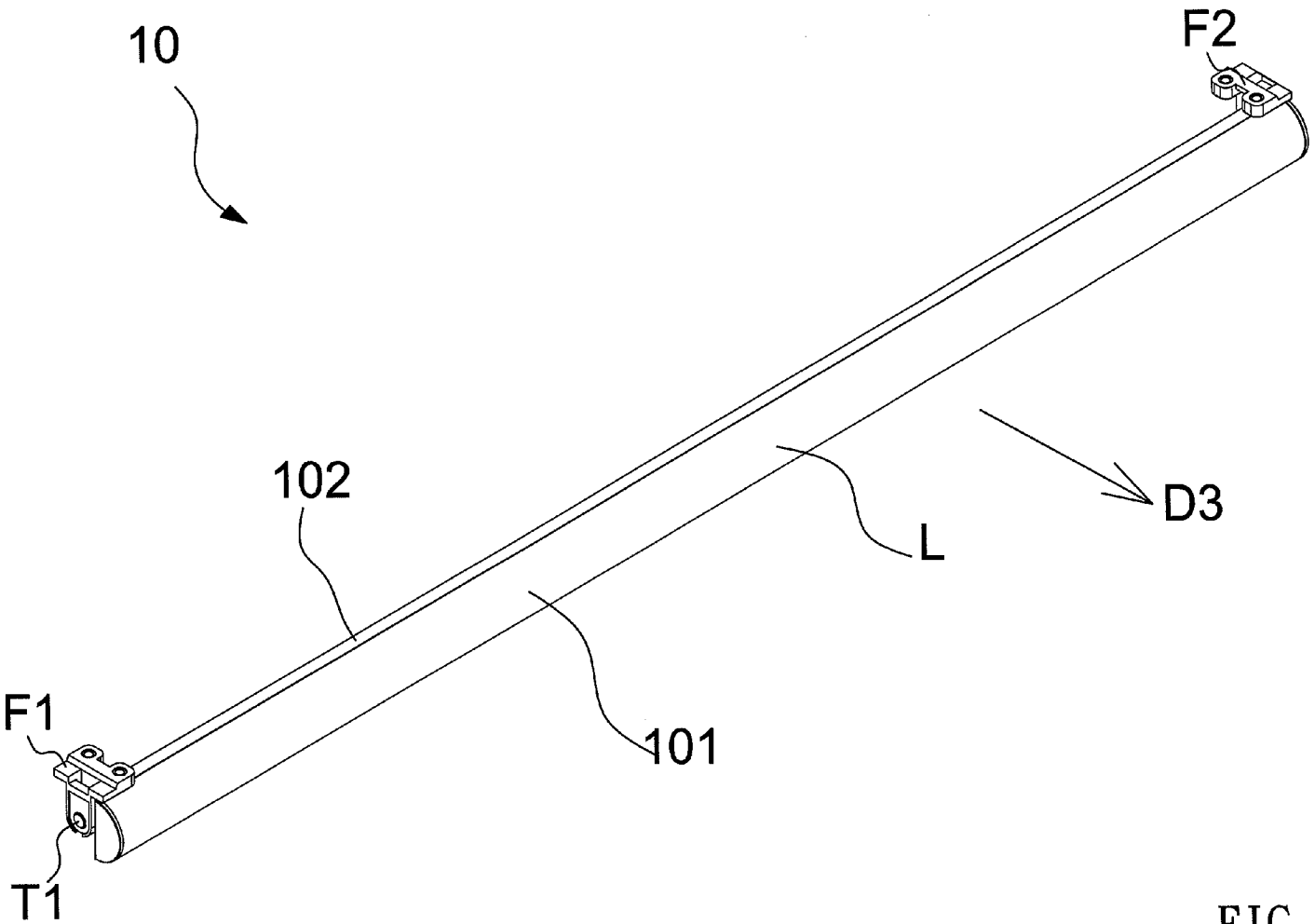
FIG. 2B shows a side-view schematic diagram illustrating a connecting part of the lighting device entering the lamp socket body according to one embodiment of the invention.
Figure 2C:
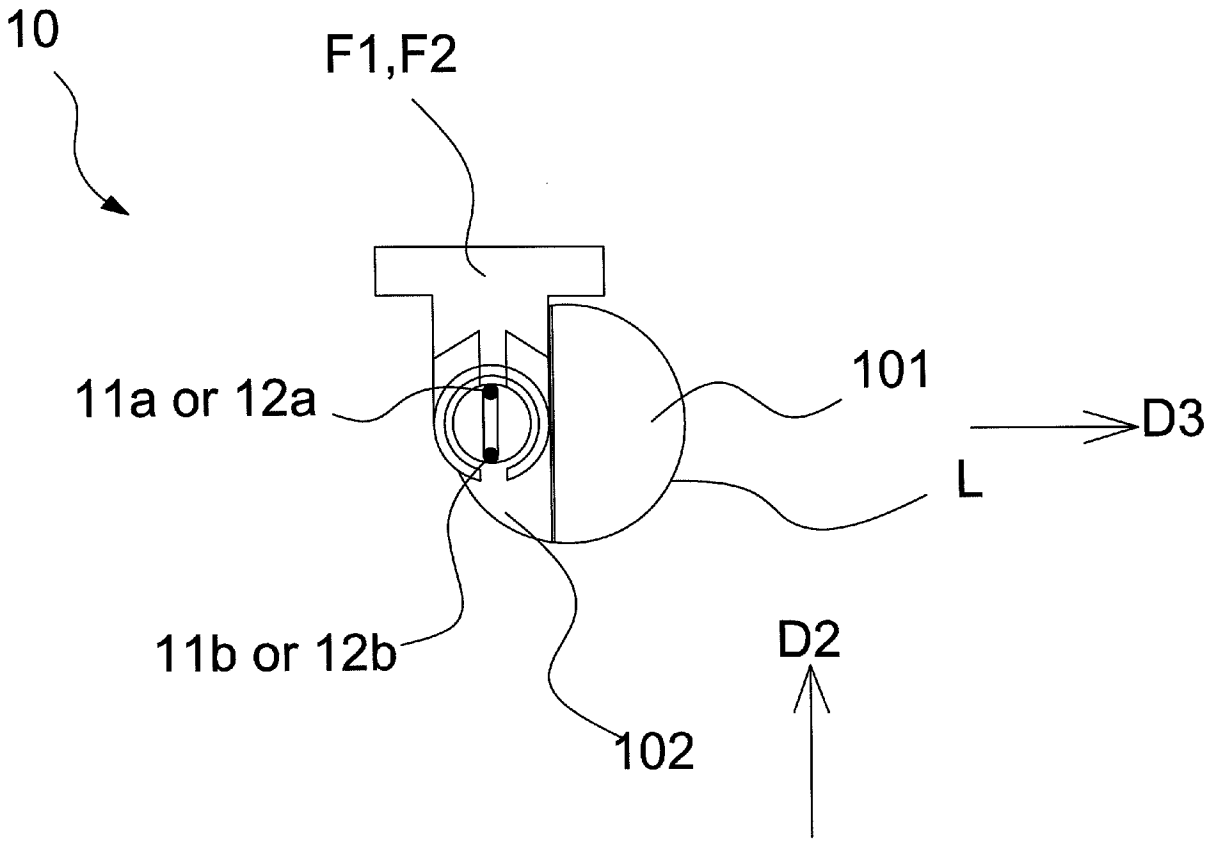
FIG. 2C shows a schematic diagram illustrating a connecting part of the lighting device entering the lamp socket body according to one embodiment of the invention.

Please simultaneously refer to FIGS. 2A, 2B and 2C. FIG. 2A shows a side-view schematic diagram illustrating a lamp socket body according to one embodiment of the invention. FIG. 2B shows a side-view schematic diagram illustrating a connecting part of the lighting device entering the lamp socket body according to one embodiment of the invention. FIG. 2C shows a schematic diagram illustrating a connecting part of the lighting device entering the lamp socket body according to one embodiment of the invention. In this embodiment, the lighting device 10 comprises a shell 100 and lamp socket bodies F1, F2.

From figures, the lamp socket body F1 has a groove G1 and a turning structure T1 and similarly the lamp socket body F2 has a groove G2 and a turning structure T2. In addition, the lamp socket bodies F1 and F2 face each other. In other words, the groove G1 and the turning structure T1 are open towards one end of the lamp body 101 and disposed perpendicular to the long line 101*a* while the groove G2 and the turning structure T2 are open towards the other end of the lamp body 101 and disposed perpendicular to the long line 101*a*. In one embodiment, the distance between the outer edge of the lamp socket body F1 and the outer edge of the lamp socket body F2 is not larger than the length of the long line 101*a* of the lamp body 101.

In one embodiment, a power conducting device (not shown) is disposed inside the lamp socket bodies F1 and F2 and coupled to the driver device and the light-emitting device to supply electric power to have the light-emitting device generate light so as to constitute a light source. The lamp socket bodies F1 and F2 can be implemented by current existed T5 lamp sockets.

When the metal connecting terminals 11 a and 11 b enter the lamp socket body F1 via the groove O1 along the direction D2, the metal connecting terminals 12*a* and 12*b* enter the lamp socket body F2 via the groove G2 along the direction D2. In one embodiment, when the metal connecting terminals 11*a* and 11*b* enter the lamp socket body F1 and the metal connecting terminals 12*a* and 12*b* enter the lamp socket body F2, the end surfaces 102*c* and 102*d* of the lamp body 102 are apart from the lamp socket bodies F1 and F2 by a distance. In another embodiment, the distance is zero.

In this embodiment, the lamp body 101 has a light-transmitting surface L and light from a light-emitting diode array as the light source is transmitted from the light-transmitting surface L. When the metal connecting terminals 11*a* and 11*b* enter the groove G1 and the metal connecting terminals 12*a* and 12*b* enter the groove G2, the light-transmitting surface L faces the direction D3 to transmit light. In one embodiment, the light-transmitting surface L can be implemented by a light diffusing cover and light from the light-emitting device exits from the light-transmitting surface L.

It should be noted that the metal connecting terminals 11*a*, 11*b*, 12*a* and 12*b* are not electrically connected to the circuits inside the lamp socket bodies F1 and F2 when the metal connecting terminals 11*a* and 11*b* enter the lamp socket body F1 and the metal connecting terminals 12*a* and 12*b* enter the lamp socket body F2. In other words, the metal connecting terminals 11*a*, 11*b*, 12*a* and 12*b* are not electrically coupled to the power conducting device.

Figure 2D:
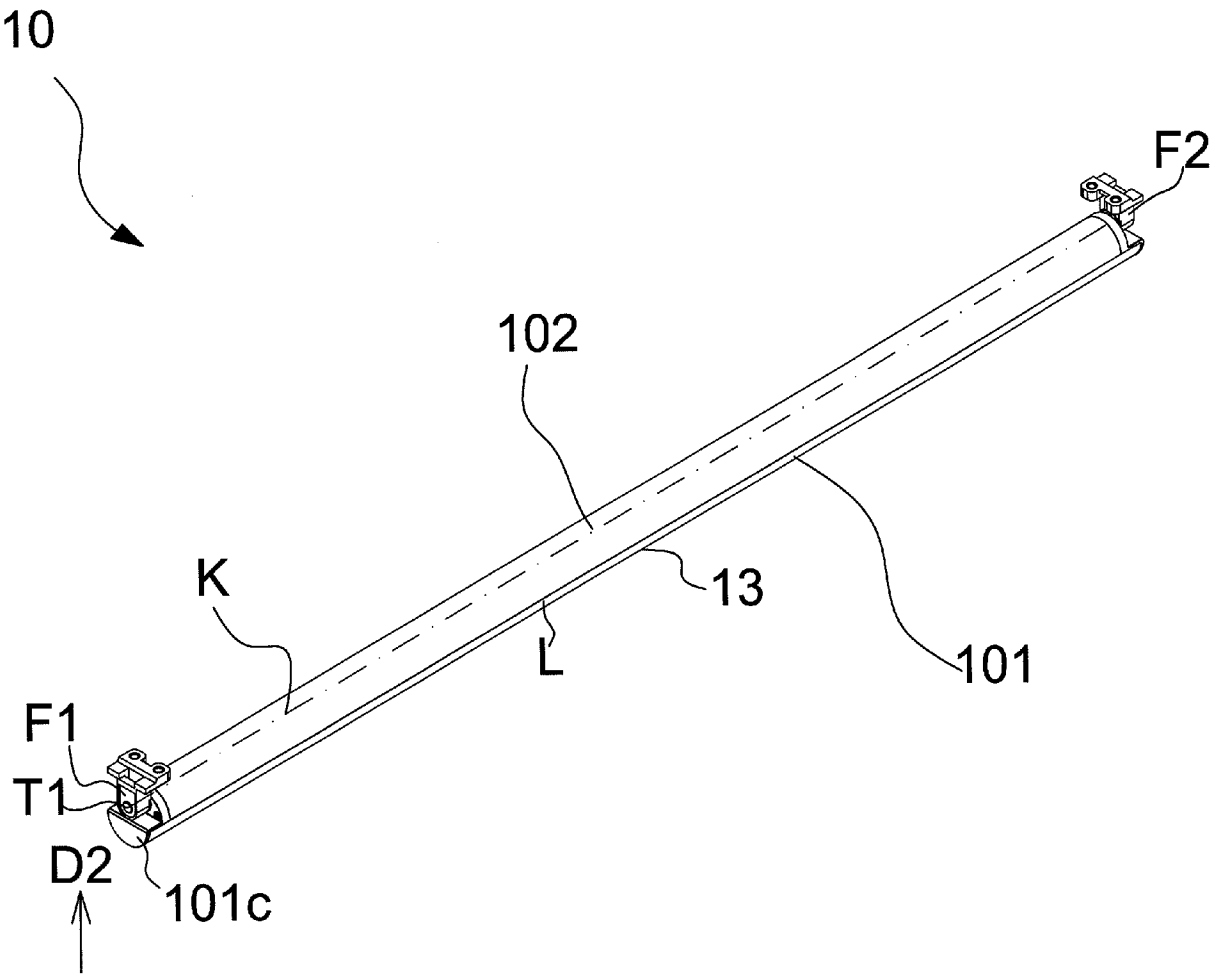
FIG. 2D shows a schematic diagram illustrating a connecting part of the lighting device mounted to the lamp socket body according to one embodiment of the invention.
Figure 2E:
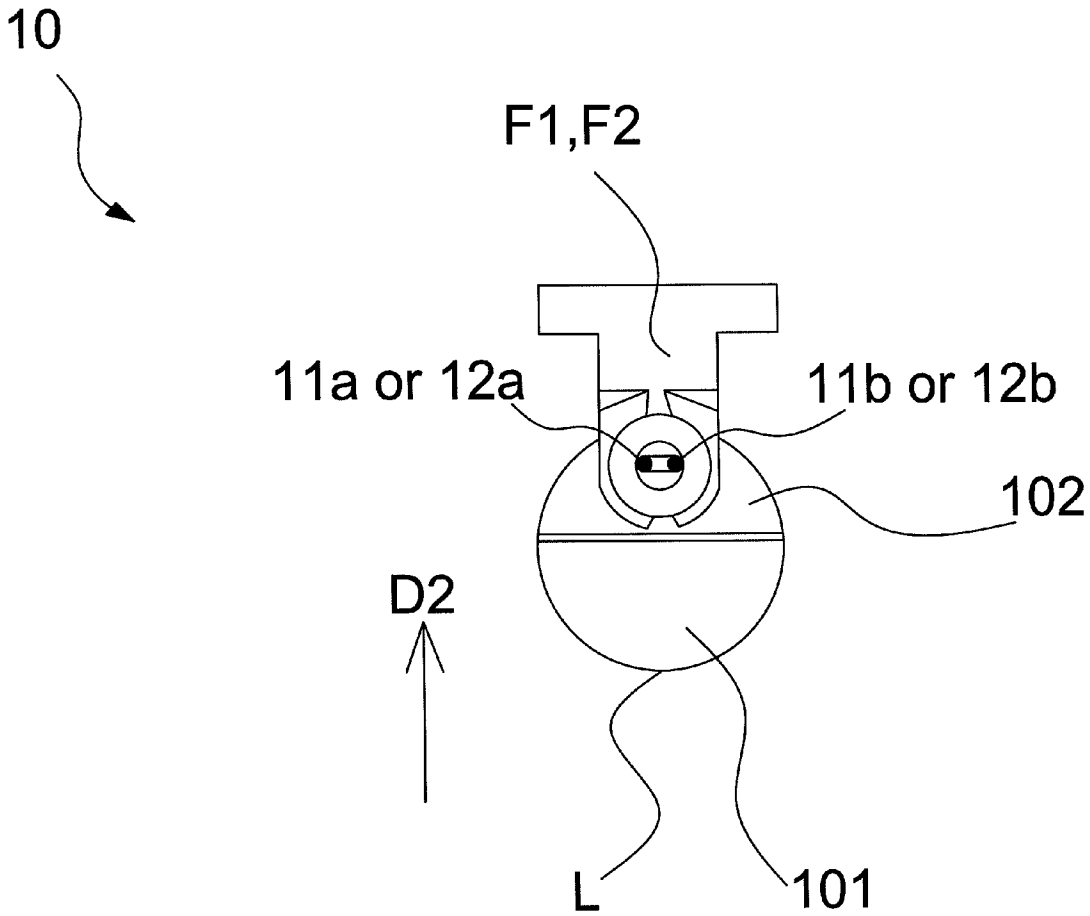
FIG. 2E shows a side-view schematic diagram illustrating a connecting part of the lighting device mounted to the lamp socket body according to one embodiment of the invention.

Please simultaneously refer to FIGS. 2D and 2E. FIG. 2D shows a schematic diagram illustrating a connecting part of the lighting device mounted to the lamp socket body according to another embodiment of the invention. FIG. 2E shows a side-view schematic diagram illustrating a connecting part of the lighting device mounted to the lamp socket body according to another embodiment of the invention. The shell 100 is mounted to the lamp socket bodies F1 and F2 after the turning structure T1 and the turning structure T2 are rotated clockwise or counterclockwise by an angle.

It should be noted that the connecting parts 103 and 104 are electrically connected respectively to the circuits inside the lamp socket bodies F1 and F2 when the shell 100 is mounted to the lamp socket bodies F1 and F2 through rotating by an angle. Thus, the power conducting device supplies electric power to the driver circuits so that the light-emitting device is driven to generate light. At the time, the light transmitting surface L faces the direction opposite to the direction D2. In this embodiment, the shell 100 is mounted to the lamp socket bodies F1 and F2 after the turning structure T1 and the turning structure T2 are rotated clockwise or counterclockwise by 90 degrees but the invention is not limited to this example.

It should be noted that the connecting parts 103 and 104 rotate on the turning structures T1 and T2, respectively. The connecting line between the center of the turning structure T1 and the center of the turning structure T2 is an eccentric axis K and the eccentric axis K does not pass through the center point O1 or O2. Such a characteristic is different from the prior art using a concentric axis during mounting.

In one embodiment, the light transmitting surface L is an arc surface and the top of the arc surface has a connecting line 13. When the shell 100 is mounted to the lamp socket bodies F1 and F2, the connecting line 13 is perpendicular to the direction D2.

Besides, when the shell 100 enters the lamp socket bodies F1 and F2, the outer edges of the end surfaces 101*c* and 101*d* of the lamp body 101 are not set extending over the outer edges of the lamp socket bodies F1 and F2. In another embodiment, the outer edges of the end surfaces 101*c* and 101*d* of the lamp body 101 are set aligned with the outer edges of the lamp socket bodies F1 and F2. In other words, the two ends of the lamp body 101 are aligned with the outer edges of the lamp socket bodies F1 and F2, separately. Thus, when the shell 100 is mounted to the lamp socket bodies F1 and F2, the lamp socket bodies F1 and F2 are shielded by the light transmitting surface L of the lamp body 101. Therefore, when a user sees the lighting device 10, there is no dark band or zone visually and the lighting zone is integral, that is, an integral whole. The lighting device 10 has a better visual effect.

Figure 3A:
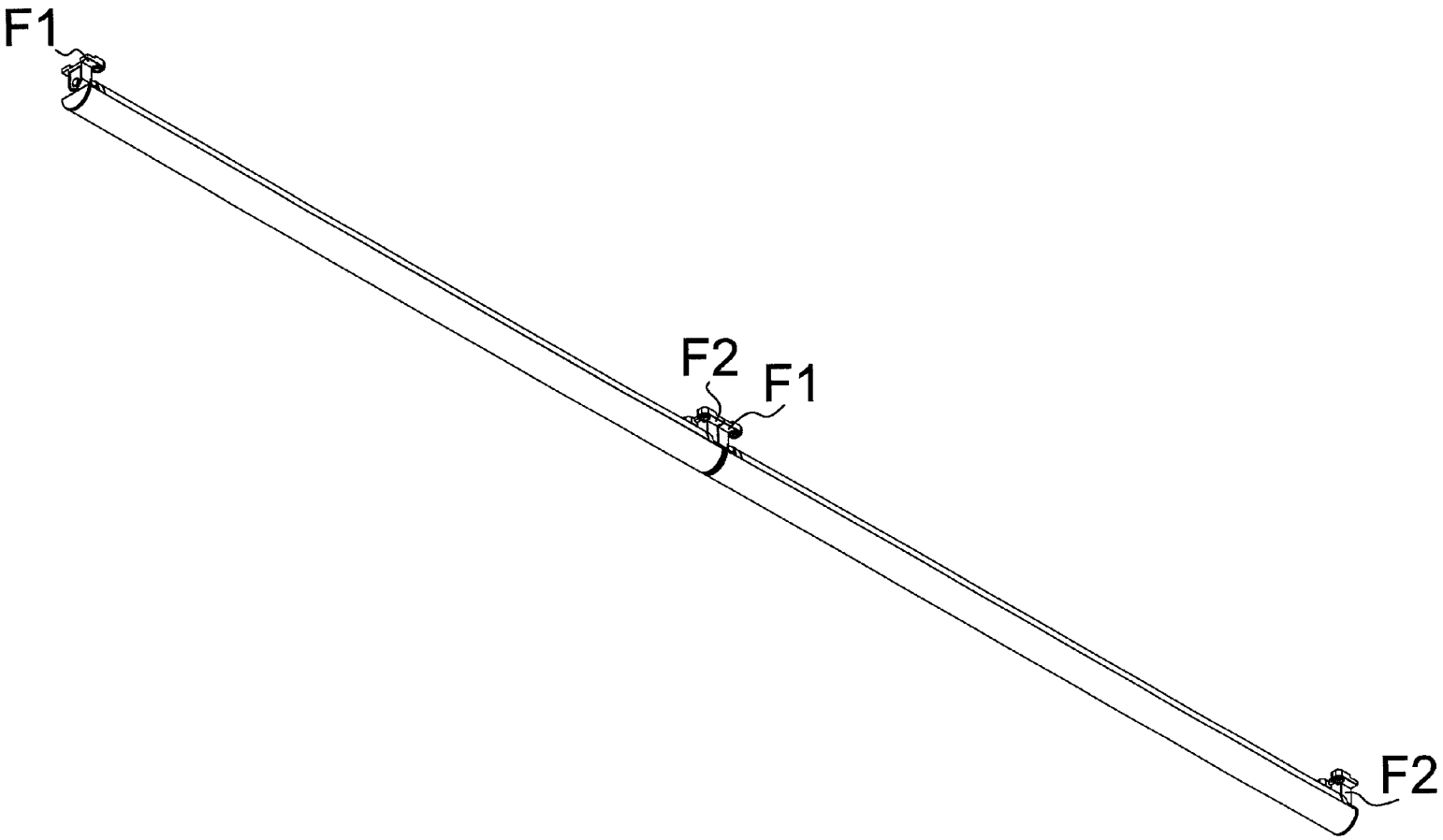
FIG. 3A shows a bottom-view schematic diagram illustrating lighting devices connected in series according to one embodiment of the invention.
Figure 3B:
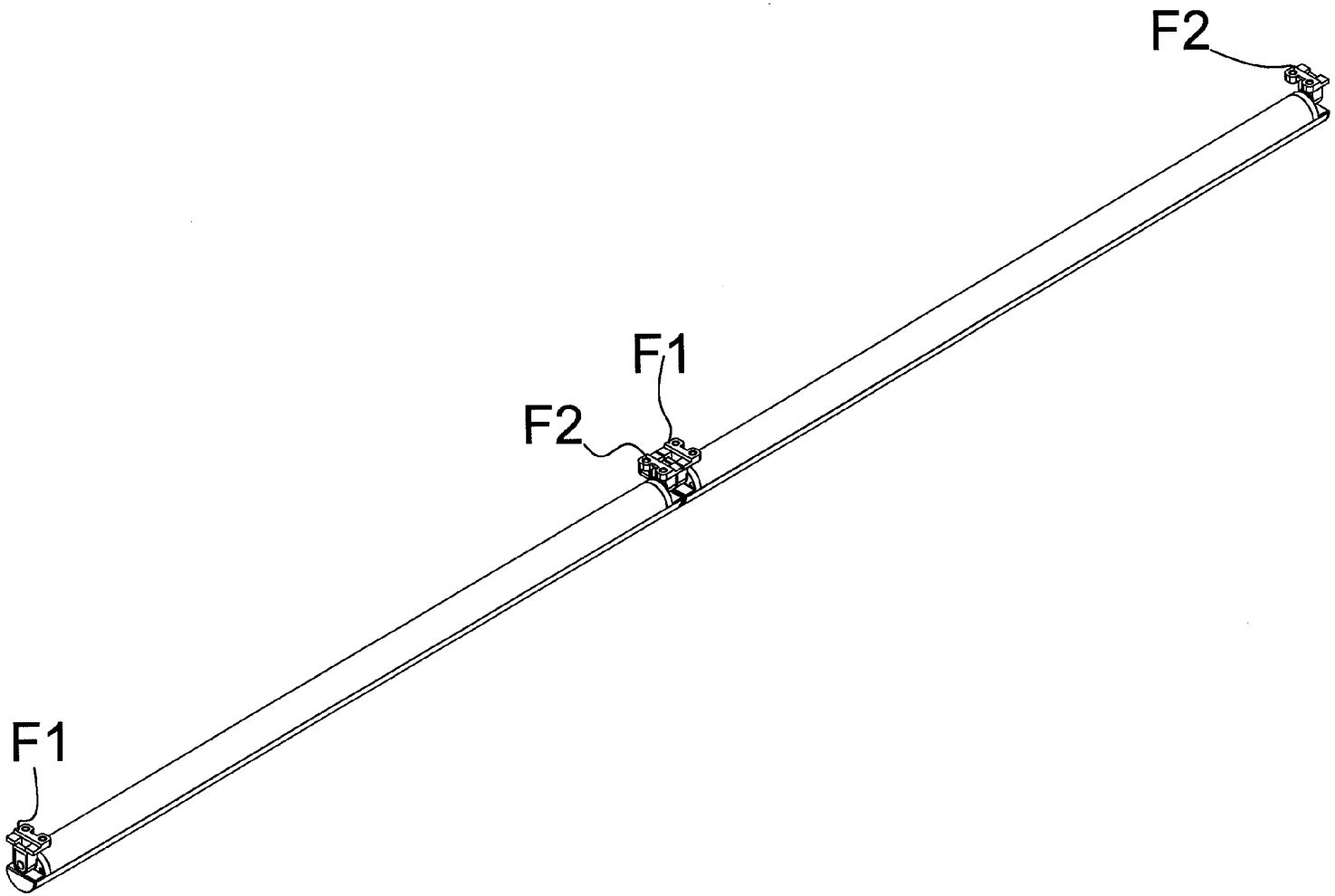
FIG. 3B shows a top-view schematic diagram illustrating lighting devices connected in series according to one embodiment of the invention.

Besides, the lighting device 10 can be connected with a plurality of lighting devices 10. In other words, the lamp socket bodies F1 and F2 of the lighting device 10 can be used to simply connect with one other lighting device 10. Please simultaneously refer to FIGS. 3A and 3B. FIG. 3A shows a bottom-view schematic diagram illustrating lighting devices connected in series according to one embodiment of the invention. FIG. 3B shows a top-view schematic diagram illustrating lighting devices connected in series according to one embodiment of the invention. The lighting devices 10 can be connected to be an "I" shape by arrangement of the lamp socket bodies F1 and F2. In other words, the lamp socket body F2 of a lighting device and the lamp socket body Fl of the other lighting device can be electrically connected via electrical wires to achieve the function of "I"-shaped connection. Therefore, a user can connect the lighting device via electrical wires and does not need additional converting device (or a special joint) for connection.

Since the lamp socket bodies F1 and F2 are shielded visually by the light transmitting surface L of the lamp body 101, the lighting zones of the lighting devices 10 after connection are continuous (that is, one integral lighting zone) and there is no dark zone.

Figure 3C:
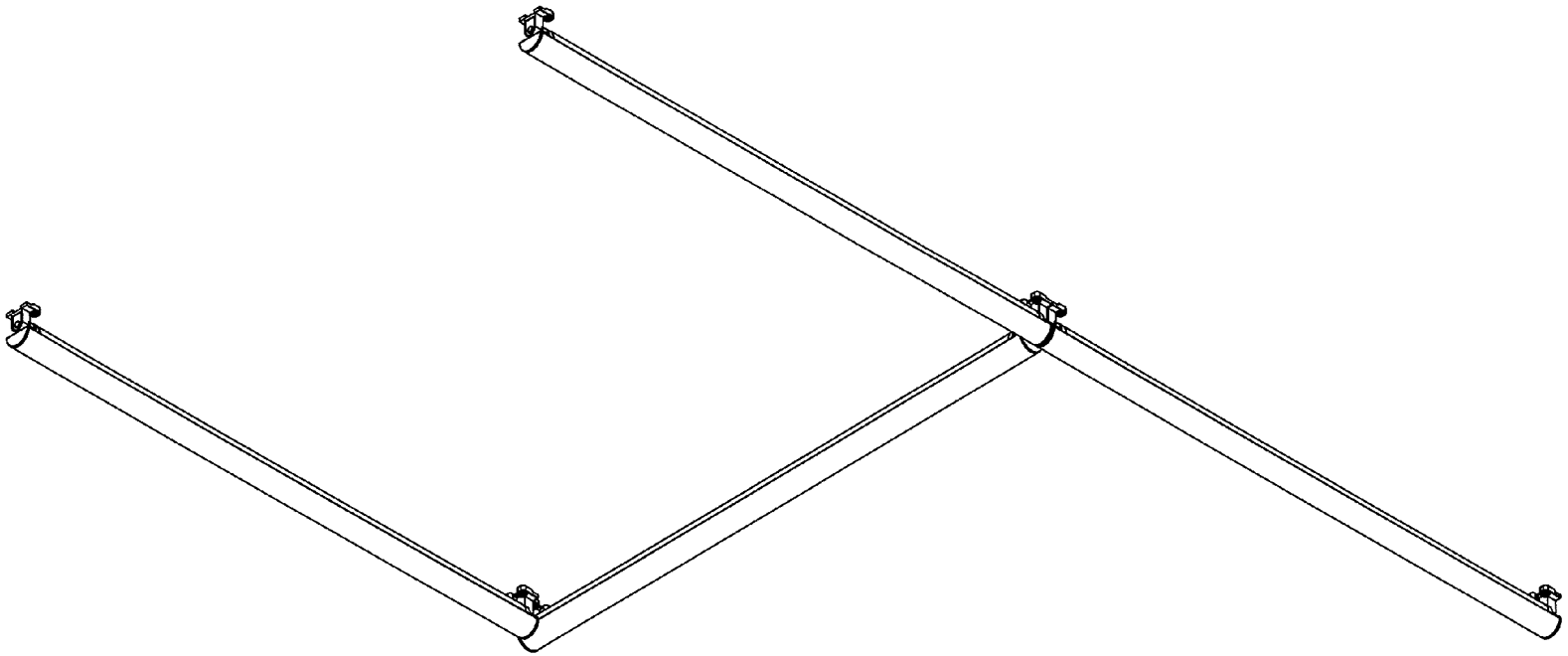
FIG. 3C shows a bottom-view schematic diagram illustrating lighting devices connected together according to one embodiment of the invention.

Similarly, please refer to FIG. 3C. FIG. 3C shows a bottom-view schematic diagram illustrating lighting devices connected together according to one embodiment of the invention. If a user needs "L"-shaped connection, the lamp socket bodies are arranged into an L-shape and the lamp socket bodies are electrically connected via electrical wires to constitute the "L"-shaped connection.

If a user needs "T"-shaped connection, the lamp socket bodies are arranged into a T-shape and the lamp socket bodies are electrically connected via electrical wires to constitute the "T"-shaped connection.

In conclusion, the lighting device of the invention can be connected to another lighting device of the invention and the quantity of the connected lighting devices can be increased or decreased as needed. The light sources of the connected lighting devices visually constitute an integral lighting zone and there is no dark zone. In other words, light is not blocked at the location of connecting two lighting devices and the lighting device has a better appearance and usability.

Although the present invention has been fully described by the above embodiments, the embodiments should not constitute the limitation of the scope of the invention. Various modifications or changes can be made by those who are skilled in the art without deviating from the spirit of the invention. Any embodiment or claim of the present invention does not need to reach all the disclosed objects, advantages, and uniqueness of the invention. Besides, the abstract and the title are only used for assisting the search of the patent documentation and should not be construed as any limitation on the implementation range of the invention.

What is claimed is:

1. A shell for a lighting device, the shell comprising:

a first lamp body, having a first long line and a first short line wherein the first long line lies along a first direction;

a second lamp body, having a second long line wherein the second long line has a length not more than that of the first long line, the second long line lies along the first direction, and two ends of the second lamp body have a first end surface and a second end surface, separately;

a first connecting part, set in the first end surface and extruding through the first end surface along the first direction; and a second connecting part, set in the second end surface and extruding through the second end surface along a direction opposite to the first direction;

wherein the first lamp body and the second lamp body are connected together, the second lamp body are drawn back inside the first lamp body, the two ends of the first lamp body are disposed extending over edges of the first end surface and the second end surface separately, and the sum of lengths of the first connecting part, the second connecting part and the second long line is not larger than that of the first long line.

2. The shell according to claim 1, wherein the geometrical center of symmetry of the first lamp body overlaps with that of the second lamp body when the first lamp body and the second lamp body are connected together.

3. The shell according to claim 2, further comprising:

a first lamp socket body, having a first groove and a first turning structure; and a second lamp socket body, having a second groove and a second turning structure wherein the distance between outer edges of the first lamp socket body and the second lamp socket body is not larger than the first long line;

wherein a position that the mid-point of the first long line and the mid-point of the first short line overlap is defined as a first center point; the second lamp body has a second short line; a position that the mid-point of the second long line and the mid-point of the second short line overlap is defined as a second center point; when the first lamp body and the second lamp body are connected together, the first center point and the second center point overlap; and the first connecting part and the second connecting part rotate on the first turning structure and the second turning structure, respectively, and a line connecting the center of the first turning structure and the center of the second turning structure does not pass through the first center point or the second center point.

4. The shell according to claim 3, wherein the first lamp body has a light-transmitting surface; when the first connecting part enters the first lamp body along a second direction via the first groove and the second connecting part enters the second lamp body along the second direction via the second groove, the shell is in a first state; and, when the shell is mounted to the first lamp socket body and the second lamp socket body by simultaneously rotating the first turning structure and the second turning structure by an angle, the shell is in a second state.

5. The shell according to claim 4, wherein the first state is that the light-transmitting surface faces a third direction.

6. The shell according to claim 4, wherein the second state is that the first connecting part and the second connecting part are electrically connected to internal circuits in the first lamp socket body and the second lamp socket body, respectively, and the light-transmitting surface faces a direction opposite to the second direction.

7. The shell according to claim 4, wherein two ends of the first lamp body have a third end surface and a fourth end surface, separately; and, when the shell enters the first lamp socket body and the second lamp socket body, outer edges of the third end surface and the fourth end surface are disposed extending over or aligned with outer edges of the first end surface and the second end surface, respectively.

8. The shell according to claim 7, wherein the first lamp body has two flat surfaces adjacent to the two end surfaces and normal to the flat surfaces is perpendicular to the first long line and the first short line.

9. The shell according to claim 8, wherein the first connecting part and the second connecting part are disposed above the normal of the flat surfaces.

10. The shell according to claim 6, wherein the light-transmitting surface is an arc surface, the top of the arc surface has a connecting line and, when the shell is mounted to the first lamp socket body and the second lamp socket body, the connecting line is perpendicular to the second direction.

11. The shell according to claim 6, wherein, when the shell is in the second state, the light-transmitting surface shields the first lamp body and the second lamp body to maintain integrity of light.

12. A lighting device, comprising:

a first lamp body, having a first long line and a first short line wherein the first long line lies along a first direction;

a light-emitting device, disposed inside the first lamp body to constitute a light source;

a second lamp body, having a second long line wherein the second long line has a length not more than that of the first long line, the second long line lies along the first direction, and two ends of the second lamp body have a first end surface and a second end surface, separately;

a driver device, coupled to the light-emitting device and disposed inside the first lamp body;

a first connecting part, set in the first end surface and extruding through the first end surface along the first direction;

a second connecting part, set in the second end surface and extruding through the second end surface along a direction opposite to the first direction; and two lamp socket bodies, comprising a power conducting device inside and coupled to the driver device and the light-emitting device wherein the lamp socket bodies each comprise a groove and a turning structure;

wherein the first lamp body and the second lamp body are connected together; the two ends of the first lamp body are disposed extending over edges of the first end surface and the second end surface separately; the total length of the first connecting part, the second connecting part and the second long line is not larger than that of the first long line; and the distance between outer edges of the lamp socket bodies is not larger than the length of the first long line.

13. The device according to claim 12, wherein the first lamp body has a light-transmitting surface; when the first connecting part enters the first lamp body along a second direction via the first groove and the second connecting part enters the second lamp body along the second direction via the second groove, the shell is in a first state; and, when the shell is mounted to the first lamp socket body and the second lamp socket body by simultaneously rotating the first turning structure and the second turning structure by an angle, the shell is in a second state.

14. The device according to claim 13, wherein the first state is that the light-transmitting surface faces a third direction.

15. The device according to claim 13, wherein the second state is that the first connecting part and the second connecting part are electrically connected to internal circuits in the first lamp socket body and the second lamp socket body, respectively, and the light-transmitting surface faces a direction opposite to the second direction.

16. The device according to claim 15, wherein, when the shell is in the second state, the light-transmitting surface shields the first lamp body and the second lamp body to maintain integrity of light sources.

17. The device according to claim 16, wherein, when the lighting device are connected in series, there is no dark band between the light sources of the lighting devices and the light sources are considered as an integral whole.

* * * * *